US005813416A

United States Patent [19]

Rudolph

[11] Patent Number: 5,813,416

[45] Date of Patent: Sep. 29, 1998

[54] FILE WITH SANITIZING AGENT

[76] Inventor: James M. Rudolph, 1150 Beacon St., Brea, Calif. 92621

[21] Appl. No.: 832,219

[22] Filed: Apr. 3, 1997

[51] Int. Cl.[6] ..... A45D 29/04

[52] U.S. Cl. ..... 132/76.4

[58] Field of Search ..... 132/76.4, 76.5; 451/344, 524, 525; 15/104.93, 104.94, 229.11

[56] References Cited

U.S. PATENT DOCUMENTS

| | | | |
|---|---|---|---|
| 2,557,175 | 6/1951 | Cortes | 132/76.4 |
| 2,699,791 | 1/1955 | Hansen | 132/76.4 |
| 3,472,675 | 10/1969 | Gordon et al. | 15/104.93 |
| 4,572,222 | 2/1986 | Pangburn | 132/76.4 |
| 4,833,003 | 5/1989 | Win et al. | 428/198 |
| 5,006,339 | 4/1991 | Bargery et al. | 424/404 |
| 5,119,839 | 6/1992 | Rudolph | 132/76.5 |
| 5,139,570 | 8/1992 | Castrogiovanni et al. | 106/3 |
| 5,419,014 | 5/1995 | Plantedosi | 15/104.94 |
| 5,656,361 | 8/1997 | Vogt et al. | 15/104.93 |
| 5,683,971 | 11/1997 | Rose et al. | 510/130 |

OTHER PUBLICATIONS

"The Technology Behind On–Page Fragrance Sampling", by Jack Charbonneau and Keith Relyea, 3M Media–Promotional Sampling Products, St. Paul, MN, DCI Feb. 1997, pp. 48–50.

"The Nail Doctor", by Richard K. Scher, M.D., NAILS Feb. 1997, pp. 144–145.

3M Promotional Fragrance Products (Library List & Pricing Schedule of fragrance samplings).

*Primary Examiner*—Todd E. Manahan

*Attorney, Agent, or Firm*—John J. Connors; Connors & Assoc.

[57] ABSTRACT

A file includes a support member having an abrasive surface with interstices holding a sanitizing agent which is released with use of the file. Microcapsules containing the sanitizing agent are preferred. The microcapsules are frangible and break upon use of the file to release the sanitizing agent. The file surface may comprise granular abrasive particulates having a size ranging from 40 to 1200 grit which provide the interstices between at least some of the particulates. An aqueous coating having dispersed therein an adhesive and the microcapsules is applied to the granular particulates. The coating is dried to deposit in the interstices the microcapsules. The adhesive binds the microcapsules to the granular particulates.

5 Claims, 1 Drawing Sheet

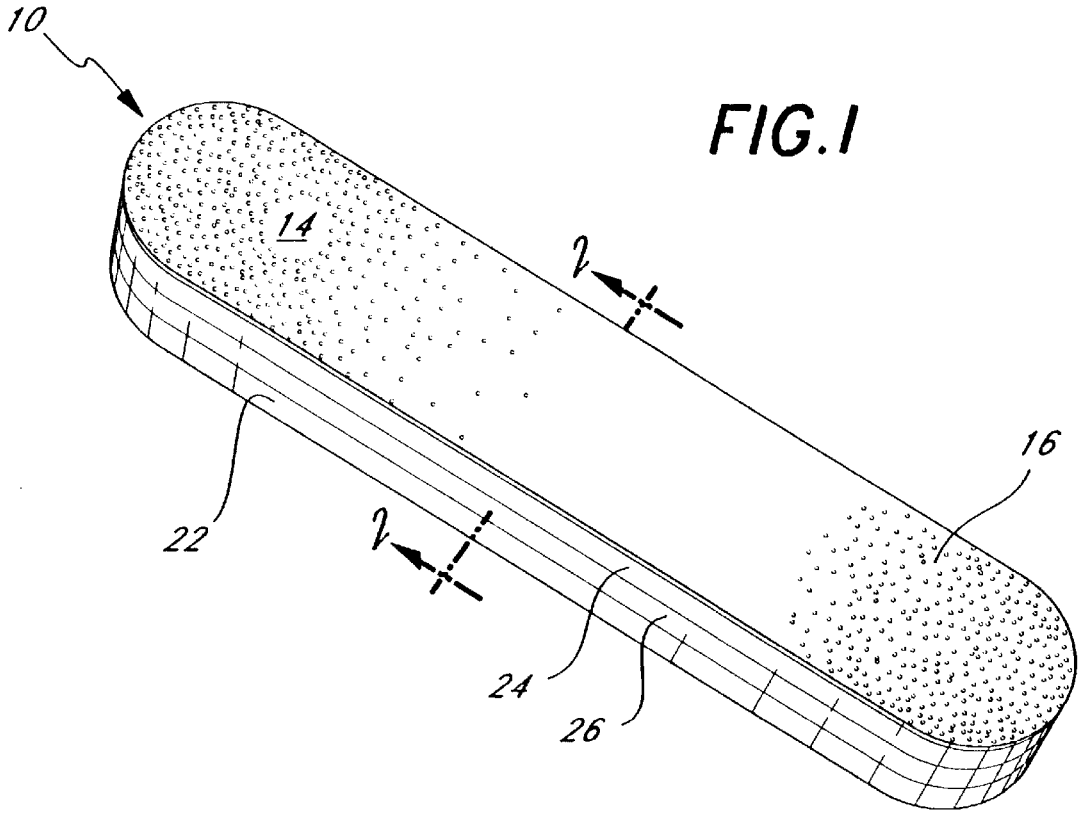
FIG. 1
FIG. 2
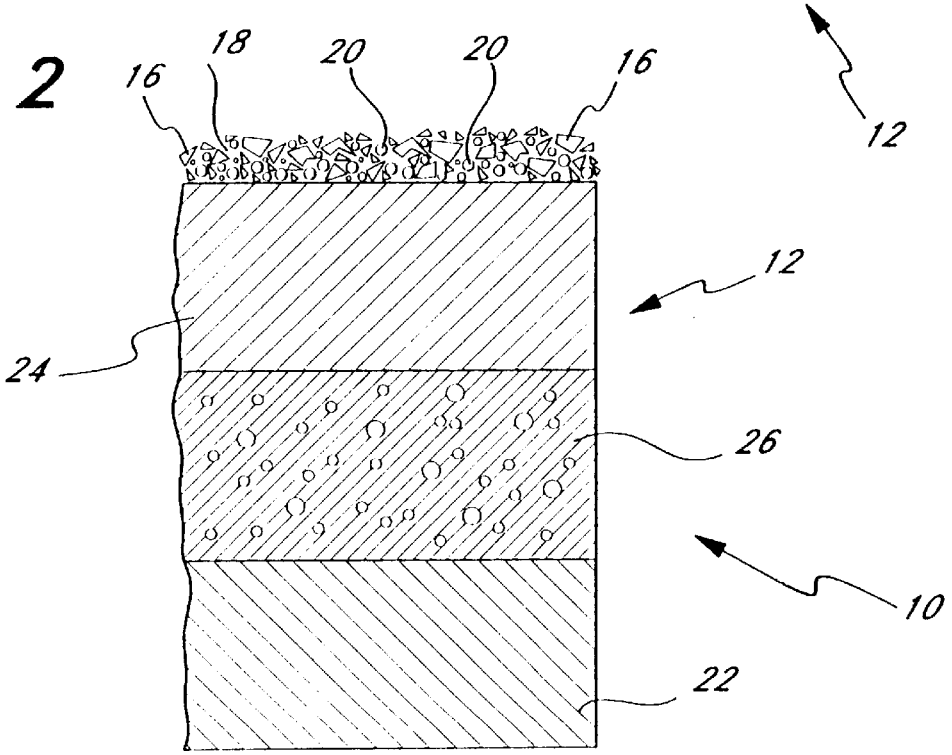

FILE WITH SANITIZING AGENT

BACKGROUND OF THE INVENTION

1. Field of the Invention

This invention relates to files used for filing human nails or callouses, and particularly, a file which has on its abrasive surface a sanitizing agent that is released during filing.

2. Background Discussion

A major problem encountered by professional nail care specialists and manicurists is fungal or other types of infection of a client's nails. In order to avoid or minimize the likelihood of spreading any infection, the nail files are stored by immersing them in a solution containing a sanitizing agent. An example of a suitable sanitizing solution is an aqueous product sold under the trademark Benz-All. A jar filled with this solution and having a moveable tray is used to hold several files. The files are supported by the tray so that they are completely immersed below the surface of the solution. The tray is manually lifted from the solution and a file removed for use. This file must then be washed and dried prior to use. This is a messy procedure. Typically, a nail file comprises a support member made of rigid plastic and covered with a water-proof sand paper. Such files are subject to attack by the solution which chemically corrodes the file, substantially shortening the useful life of the file.

SUMMARY OF THE INVENTION

It is the objective of this invention to provide a file which contains a sanitizing agent which is released upon use of the file.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include minimizing the likelihood of fungal or other infection of nails, prolonging the useful life of the file, and avoiding messy or inconvenient storage procedures for files.

The first feature of the file of this invention is that it includes a support member having an abrasive surface. The support member may be made of paper, plastic film, plastic foam, metal, or fabric. It may be in the shape of a disk, board or block, and may be multilayered, for example, comprising a rigid plastic board covered with a sand paper and having a foam layer between the board and the sand paper. A foam layer of polyurethane foam is commonly employed.

The second feature is that the abrasive surface has interstices which are at least partially filled with a sanitizing agent. Microcapsules containing a sanitizing agent are employed in the preferred embodiment of this invention. These microcapsules are frangible and break upon use of the file to release the sanitizing agent. The microcapsules comprises a generally hollow, spherical shell having a thin, frangible wall with a thickness ranging between 1/50 and 1/200 micron. The microcapsules typically have a diameter ranging between about 12 and about 50 microns. The shell should be inert with respect to the sanitizing agent.

The third feature is that the abrasive surface may comprise granular abrasive particulates and the interstices are between at least some of the particulates. Typically, the particulates have a size ranging from about 40 to about 1200 grit, preferably 80 to 400 grit. The preferred particulates are silicon carbide, aluminium oxide, silica, or zirconia. Using any suitable adhesive, these particulates are bonded to the surface of a support sheet of, for example, plastic or paper, covering substantially the entire surface of the support sheet. This support sheet is then glued to the surface of a rigid support member such as, for example, a plastic board or block, either a foam or non-foam material.

The fourth feature is the manner in which the microcapsules are applied to the abrasive surface. Typically, they are first dispersed in an aqueous medium with an adhesive that is water soluble. This mixture of microcapsules, adhesive, and water comprises from about 30 to 40 percent by weight solids. It is applied as a thin coating to the abrasive surface, and allowed to dry. It may be heated above ambient temperature to about 200° to about 225° F. to facilitate removal of the water. The microcapsules remain in the interstices of the abrasive surface, with the adhesive securing them to this surface.

The fifth feature is that the sanitizing agent is a fungicide, a germicide, or a mixture of both. A wide variety of sanitizing agents are available and new ones are constantly being developed with improved properties. Suitable fungicides are itraconazole, terbinafine, and fluconazole. Itraconazole, terbinafine, and fluconazole are being investigated for ingestion by a patient suffering from onychomycosis (fungal infection), but may be used as an externally applied agent as contemplated in the present invention. Suitable germicides are dimethyl benzyl, ethyl benzyl, gasoline, or pine oil.

This invention also includes a method of treating a human nail to inhibit or prevent infection. This method includes:

(a) filing the nail with a file including a support member having an abrasive surface, said surface having interstices which are at least partially filled with a sanitizing agent that is released upon use of the file, and (b) applying sufficient pressure during filing to release the sanitizing agent, so that said sanitizing agent contacts the nail being filed.

DESCRIPTION OF THE DRAWING

The preferred embodiment of this invention, illustrating all its features, will now be discussed in detail. This embodiment depicts the novel and non-obvious file and method of this invention as shown in the accompanying drawing, which is for illustrative purposes only. This drawing includes the following figures (FIGS.), with like numerals indicating like parts:

FIG. 1 is a perspective view of a nail file embodying the present invention.

FIG. 2 is a cross-sectional view taken along line 2—2 of FIG. 1, greatly enlarged and schematically illustrating microcapsules deposited between interstices in the abrasive surface of the file.

DETAILED DESCRIPTION OF THE PREFERRED EMBODIMENT

As depicted in FIGS. 1 and 2, a nail file 10 of this invention includes a support member 12 having an abrasive surface 14. The abrasive surface 14 comprises granular abrasive particulates 16 with interstices 18 (FIG. 2) between the particulates. Silicon dioxide particulates having a size ranging between 80 and 400 grit are preferred and they may be the same or different sizes. The interstices 18 are at least partially filled with microcapsules 20 (FIG. 2) that contain a sanitizing agent (not shown).

Microencapsulation processes have commonly been used to encapsulate perfumes and these processes are discussed in an article published in the February 1997 edition of the magazine DCI. This well known process is simply modified by replacing the perfume with the sanitizing agent. The sanitizing agent is in the form of an oil based product. It is mixed with an aqueous solution of low molecular weight, water soluble polymers and stirred vigorously to form minuscule oleaginous droplets of the sanitizing agent. A suitable polymer material is, for example, polyoxymethylene urea. A catalyst is added to the aqueous solution which causes the low molecular weight polymer to increase in weight and become water insoluble. As this occurs, the droplets of the sanitizing agent are encased within a shell composed of the higher molecular weight polymer to form the microcapsules 20 which precipitate from the aqueous solution. The microcapsules are then washed and dispersed in an aqueous based coating, including an adhesive, for application to the support member 12. A suitable adhesive is, for example, rubber cement.

The support member comprises a rigid plastic board 22 and the abrasive surface 14 is provided by a water proof sand paper type sheet 24. Preferably, a polyurethane foam layer 26 is sandwiched between the board 22 and the sheet 24. The board 22, layer 26, and sheet 24 are assembled as a unit after applying to the abrasive surface 14 of the sheet 24 the aqueous coating containing the microcapsules 20. Upon drying of the coating, the adhesive bonds the microcapsules 20 to the abrasive surface 14, which are lodged in the interstices 18.

The file 10 is used in the normal fashion by rubbing the abrasive surface 14 against a human nail or callous. This rubbing causes the microcapsules 20 to fracture and release the sanitizing agent which contacts the nail or callous being filed to inhibit or prevent infection. Advantageously, only the very uppermost microcapsules 20 at the surface 14 are fractured, leaving behind unfractured microcapsules that are eventually fractured as the surface 14 is gradually worn away with continued use of the file 10.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

I claim:

1. A method of treating a human nail to inhibit or prevent infection comprising (a) filing the nail with a file including a support member having an abrasive surface, said surface having interstices which are at least partially filled with a sanitizing agent that is released upon use of the file, and (b) applying sufficient pressure during filing to release the sanitizing agent, so that said sanitizing agent contacts the nail being filed.

2. The method of claim 1 where the sanitizing agent is contained within microcapsules that are frangible and break upon use of the file to release the sanitizing agent.

3. The method of claim 2 the sanitizing agent is a fungicide, a germicide, or a mixture of both.

4. The method of claim 3 where the fungicide is itraconazole, terbinafine, or fluconazole.

5. The method of claim 3 where the germicide is dimethyl benzyl, ethyl benzyl, gasoline, or pine oil.

* * * * *